US010568482B2

(12) United States Patent
Sun et al.

(10) Patent No.: US 10,568,482 B2
(45) Date of Patent: Feb. 25, 2020

(54) CLEANER

(71) Applicant: LG ELECTRONICS INC., Seoul (KR)

(72) Inventors: Changhwa Sun, Seoul (KR); Sangjo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 237 days.

(21) Appl. No.: 15/856,213

(22) Filed: Dec. 28, 2017

(65) Prior Publication Data

US 2018/0184871 A1 Jul. 5, 2018

(30) Foreign Application Priority Data

Dec. 30, 2016 (KR) ..... 10-2016-0184433
Oct. 16, 2017 (KR) ..... 10-2017-0134162

(51) Int. Cl.
*A47L 11/40* (2006.01)
*A47L 9/04* (2006.01)
(Continued)

(52) U.S. Cl.
CPC ..... *A47L 11/4036* (2013.01); *A46B 15/0002* (2013.01); *A46B 15/0004* (2013.01); *A47L 9/0411* (2013.01); *A47L 9/0455* (2013.01); *A47L 9/0477* (2013.01); *A47L 9/22* (2013.01); *A47L 9/2821* (2013.01); *A47L 9/2826* (2013.01); *A47L 9/2842* (2013.01); *A47L 9/2884* (2013.01); *A47L 11/4011* (2013.01); *A47L 11/4041* (2013.01);
(Continued)

(58) Field of Classification Search
CPC .... A47L 9/0455; A47L 9/0477; A47L 9/1455; A47L 9/0411; A47L 9/0405; A47L 11/4041; A47L 11/4036; A46B 15/0002; A46B 15/0004; H01L 21/02041–02101
USPC ..... 15/392, 41.1, 50.3, 52.1, 98
See application file for complete search history.

(56) References Cited

U.S. PATENT DOCUMENTS 3,790,987 A * 2/1974 MacFarland ..... A47L 5/30 15/392
6,134,745 A 10/2000 Wörwag
(Continued)

FOREIGN PATENT DOCUMENTS

KR 10-0738886 7/2007
KR 10-2009-0131098 12/2009
(Continued)

OTHER PUBLICATIONS

U.S. Notice of Allowance dated Oct. 3, 2019 issued in U.S. Application No. 15/854,454.

*Primary Examiner* — Bryan R Muller
(74) *Attorney, Agent, or Firm* — KED & Associates, LLP

(57) ABSTRACT

Disclosed is a cleaner having a structure that a supporting member and a cleaning module are coupled to or separated from a cleaner body. The cleaner includes a cleaner body having a module mounting portion; a supporting member inserted and mounted to the module mounting portion, and separated and withdrawn from the module mounting portion, through a bottom part of the cleaner body; and a cleaning module coupled to the supporting member so as to be inserted or withdrawn together with the supporting member when the supporting member is inserted or withdrawn.

13 Claims, 14 Drawing Sheets

(51) Int. Cl.

| | |
|---|---|
| ***A47L 9/28*** | (2006.01) |
| ***A47L 9/22*** | (2006.01) |
| ***A46B 15/00*** | (2006.01) |
| *A47L 9/00* | (2006.01) |

(52) U.S. Cl.
CPC ..... *A47L 11/4044* (2013.01); *A47L 9/00* (2013.01); *A47L 9/009* (2013.01); *A47L 2201/00* (2013.01); *A47L 2201/06* (2013.01)

(56) References Cited

U.S. PATENT DOCUMENTS

| | | | | |
|---|---|---|---|---|
| 6,324,714 | B1 | 12/2001 | Walz et al. | |
| 7,441,298 | B2 | 10/2008 | Svendsen et al. | |
| 8,387,193 | B2 | 3/2013 | Ziegler et al. | |
| 8,567,007 | B2 | 10/2013 | Song et al. | |
| 8,584,305 | B2 | 11/2013 | Won et al. | |
| 8,720,001 | B2 | 5/2014 | Courtney et al. | |
| 8,898,858 | B2 | 12/2014 | Dyson et al. | |
| 9,687,129 | B2 | 6/2017 | Kim et al. | |
| 9,833,116 | B2 * | 12/2017 | Huang | A47L 9/2857 |
| 10,292,552 | B2 * | 5/2019 | Lim | A47L 7/0066 |
| 2007/0244610 | A1 | 10/2007 | Ozick et al. | |
| 2010/0037418 | A1 | 2/2010 | Hussey et al. | |
| 2017/0265701 | A1 | 9/2017 | Kim et al. | |
| 2017/0296021 | A1 | 10/2017 | Li et al. | |

FOREIGN PATENT DOCUMENTS

| | | |
|---|---|---|
| KR | 10-1074937 | 10/2011 |
| KR | 10-2014-0123091 | 12/2014 |
| KR | 10-2016-0023120 | 3/2016 |
| KR | 10-2016-0035943 | 4/2016 |
| KR | 10-1641262 | 7/2016 |
| WO | WO 2013/106762 | 7/2013 |

* cited by examiner

CLEANER

CROSS-REFERENCE TO RELATED APPLICATIONS

This application claims priority under 35 U.S.C. § 119 to Korean Application No. 10-2016-0184433, filed on Dec. 30, 2016, and Korean Application No. 10-2017-0134162, filed on Oct. 16, 2017, whose entire disclosures are hereby incorporated by reference.

BACKGROUND

1. Field

This specification relates to a cleaner having a cleaning module which can be sanitarily managed.

2. Background

A cleaner is an apparatus for performing a vacuum cleaning function which collects dust by separating the dust and foreign materials from sucked air, or performing a mop cleaning function through a mopping operation. The cleaner is configured to simultaneously suck dust and air, and to separate the dust from the sucked air. The dust separated from the air is collected at a dust collector, and the air is discharged out of the cleaner. During this process, dust is accumulated not only in the dust collector, but also in the cleaner.

Therefore, the cleaner should be managed in order to maintain a clean state and a cleaning function. The management of the cleaner means periodically discharging dust collected at the dust collector, removing dust accumulated in the cleaner rather than the dust collector, etc. For management of the cleaner, components of the cleaner should be separated from a cleaner body. However, in this process, a user should touch the components of the cleaner by hand, and may touch dust accumulated in the cleaner by hand. This may cause a problem in a sanitary aspect.

For instance, U.S. Pat. No. 8,720,001 (issued on May 13, 2014) discloses a configuration that an agitator is formed to be separable from a cleaner body. According to the patent document, a user should overturn a cleaner to take an agitator out by hand, in order to disassemble the agitator. Accordingly, the cleaner has a problem in a sanitary aspect that a user should touch dust accumulated in the agitator. The above reference is incorporated by reference herein where appropriate for appropriate teachings of additional or alternative details, features and/or technical background.

Recently, a cleaner having both a vacuum cleaning function and a mopping function is being developed. For usage of such a cleaner, a user detachably couples a brush assembly or a mop assembly to a cleaner body according to a desired cleaning type. However, in this case, it is impossible to change a cleaning mode of the cleaner in accordance with the mounted assembly.

BRIEF DESCRIPTION OF THE DRAWINGS

The embodiments will be described in detail with reference to the following drawings in which like reference numerals refer to like elements, and wherein.

DETAILED DESCRIPTION

Figure 1:
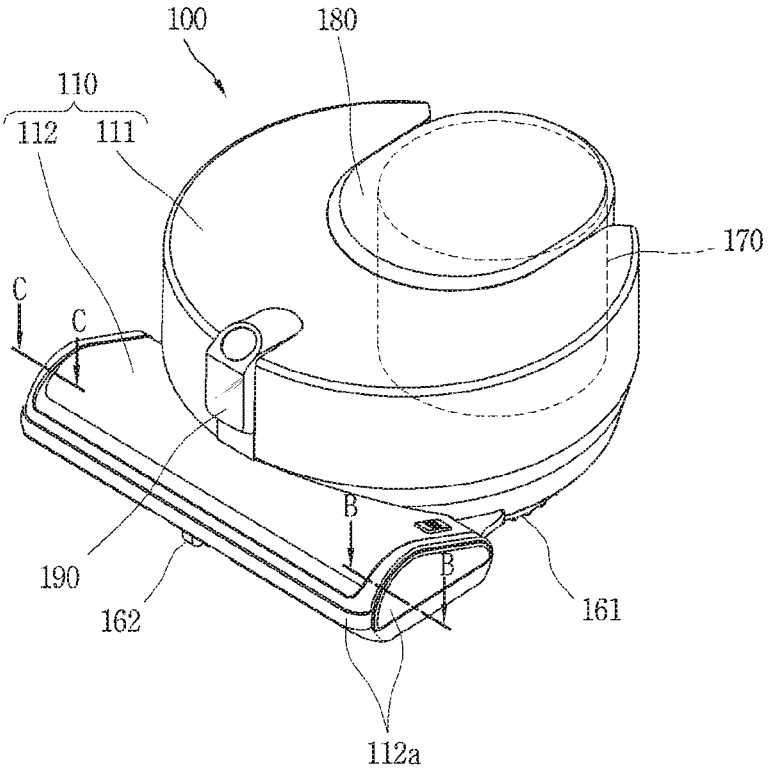
FIG. 1 is a perspective view showing an example of a cleaner according to the present disclosure.
Figure 2:
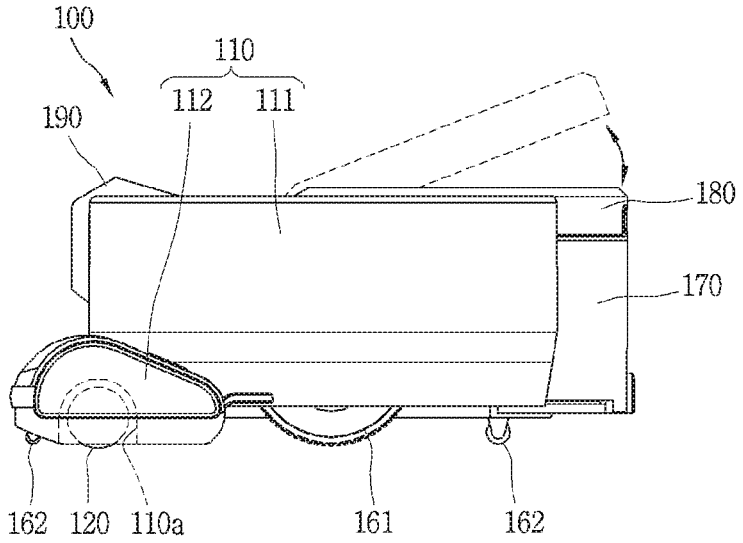
FIG. 2 is a side sectional view of the cleaner shown in FIG. 1.

FIG. 1 is a perspective view showing an example of a cleaner according to the present disclosure, and FIG. 2 is a side sectional view of the cleaner shown in FIG. 1. In the drawings, a robot cleaner 100 for sucking dust on a floor while autonomously driving on a predetermined region is shown as an example of a cleaner. However, the present disclosure is not limited to the robot cleaner 100, but may be applicable to a general vacuum cleaner such as canister type and an upright type. The robot cleaner 100 may perform not only a function to suck dust on a floor, but also a function to mop a floor. For this, the robot cleaner 100 includes a cleaner body 110 and a cleaning module 120 (or roller).

The cleaner body 110 forms appearance of the robot cleaner 100. The cleaner body 110 includes a controller (not shown) for controlling the robot cleaner 100, and various types of components are mounted in the cleaner body 110. In the drawings, the cleaner body 110 includes a main housing 111, and a module mounting housing (or roller mounting housing) 112 coupled to the main housing 111 in a protruding manner. A main printed circuit board 113 (refer to FIG. 12) which constitutes the controller is mounted in the main housing 111, and a module mounting portion 110*a* for detachably mounting the cleaning module 120 is formed at the module mounting housing 112. However, the present disclosure is not limited to this. The cleaner body 110 may include only the main housing 111. In this case, the module mounting portion 110*a* may be formed at the main housing 111.

A bumper switch 112*a* for sensing a physical collision may be installed at the cleaner body 110. The bumper switch 112*a* may include a bumper member 112*a*' which moves inward by a physical collision with an obstacle, and a switch 112*a*" pressurized when the bumper member 112*a*' moves inward (see FIG. 9). In the drawings, the bumper switch 112*a* is provided at the module mounting housing 112. The bumper switch 112*a* is provided on a front surface of the module mounting housing 112. In some cases, as shown, the bumper switch 112*a* may be provided on both side surfaces of the module mounting housing 112.

Wheels for driving are provided at the cleaner body 110. The wheels may be provided on right and left sides of the cleaner body 110. By the wheels, the cleaner body 110 may be moved back and forth and right and left, or may be rotated. For instance, if the robot cleaner 100 has an autonomous driving function, the wheels may be implemented as driving wheels 161 rotated by receiving a driving force. As another example, if the cleaner body 110 is moved by a user's manipulation, the wheels may have only a rolling function on a floor.

An auxiliary wheel 162 may be further provided at the cleaner body 110. The auxiliary wheel 162 supports the cleaner body 110 together with the driving wheels 161, and assists a driving of the robot cleaner 100 by the driving wheels 161. As shown, if the module mounting housing 112 is protruding from the main housing 111, the auxiliary wheel 162 may be provided at the module mounting housing 112 for a stable driving of the robot cleaner 100.

The cleaning module 120 is configured to clean a floor. Dust and foreign materials included in air sucked through the cleaning module 120 are filtered to be collected at a dust container 170. Then, the air separated from the dust and foreign materials is discharged to the outside of the cleaner body 110. An air suction passage (not shown) for guiding an air flow from the module mounting portion 110*a* to the dust container 170 may be formed in the cleaner body 110. Further, an air discharge passage (not shown) for guiding an air flow from the dust container 170 to the outside of the cleaner body 110 may be formed in the cleaner body 110.

The cleaning module 120 may selectively include a different type of cleaning member. The cleaning member indicates a brush, a rag or mop, etc. A type of the cleaning module 120 may be determined according to a type of the cleaning member. For instance, the cleaning module 120 having a brush may be categorized as a brush module (or brush roller) 140 (refer to FIG. 5), and the cleaning module 120 having a mop may be categorized as a mop module (or mop roller) 150 (refer to FIG. 6). One of the brush module and the mop module may be detachably coupled to the module mounting portion (or module mounting recess) 110*a*. A user may replace the cleaning member or the cleaning module 120 according to a cleaning purpose.

The type of the cleaning member is not limited to a brush or a mop. Accordingly, the cleaning module having a different type of cleaning member may be referred to as a first type cleaning module and a second type cleaning module. The first cleaning module includes a first type cleaning member, and the first type cleaning member may mean a brush, for instance. Likewise, the second type cleaning module includes a second type cleaning member, and the second type cleaning member may mean a mop, etc. rather than a brush.

At least one of a filter and a cyclone for filtering dust and foreign materials included in sucked air may be provided at the dust container 170. The robot cleaner 100 may be provided with a dust container cover 180 for covering the dust container 170. In a state that the dust container cover 180 is provided to cover an upper surface of the dust container 170, the dust container 170 may be prevented from being separated from the cleaner body 110 by the dust container cover 180.

FIG. 2 shows that the dust container cover 180 is coupled to the cleaner body 110 by a hinge so as to be rotatable. The dust container cover 180 is fixed to the dust container 170 or the cleaner body 110, and covers an upper surface of the dust container 170.

If the robot cleaner 100 has an autonomous driving function, a sensing unit (or sensor) 190 for sensing a peripheral situation may be provided at the cleaner body 110. The controller may sense an obstacle or a geographic feature by the sensing unit 190, or may generate a map of a driving region.

Figure 3:
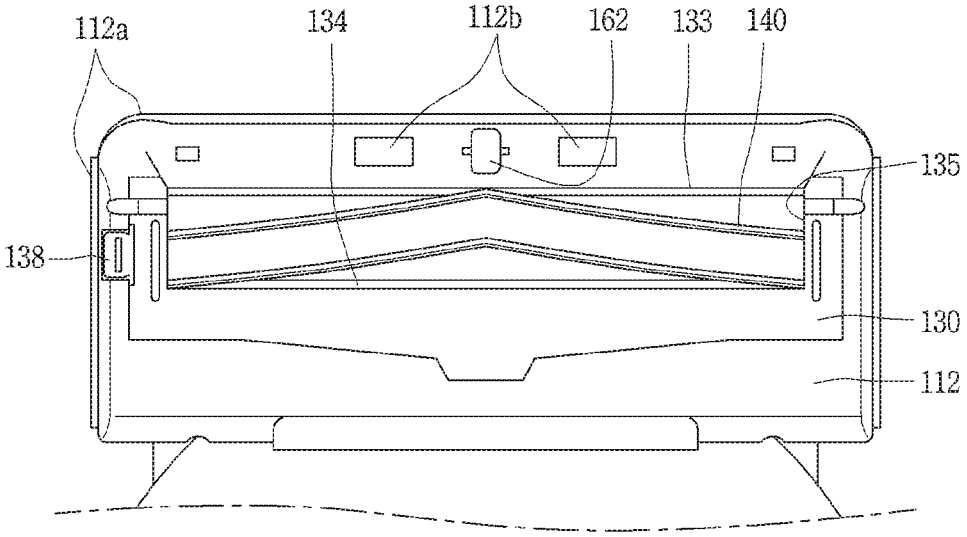
FIG. 3 is a conceptual view showing a bottom part of a cleaner body shown in FIG. 1.

Next, a bottom structure of the cleaner body 110 will be explained. FIG. 3 is a conceptual view showing a bottom part of the cleaner body 110 shown in FIG. 1.

A cliff sensor 112*b* for sensing a lower terrain may be provided at a bottom part of the cleaner body 110. In the drawings, the cliff sensor 112*b* is provided at a bottom part of the module mounting housing 112. The cliff sensor 112*b* may be provided at a bottom part of the main housing 111.

The cliff sensor 112*b* includes a light emitting portion and a light receiving portion, and time when light irradiated to a floor from the light emitting portion is received by the light receiving portion is measured. Based on the measured time, a distance between the cliff sensor 112*b* and the floor is measured. Accordingly, when there is a stairstep portion having its height lowered drastically at a front side, the reception time is drastically increased. If there is a cliff at a front side, light is not received by the light receiving portion.

If it is sensed, through the cliff sensor 112*b*, that a lower terrain becomes lower by more than a predetermined level, the controller controls a driving of the driving wheels 161 (refer to FIG. 1). For instance, the controller may apply a driving signal in an opposite direction to the driving wheels 161 such that the robot cleaner 100 may move in an opposite direction. Alternatively, for rotation of the robot cleaner 100, the controller may apply a driving signal to only one of the driving wheels 161, or may apply different driving signals to the right and left driving wheels 161.

The cleaning module for cleaning a floor may be detachably coupled to the module mounting portion 110*a* of the cleaner body 110. In the drawings, the brush module 140 is shown as an example of the cleaning module. However, the brush module 140 of the present disclosure may be applied to a general cleaning module such as a mop module 150 to be explained later.

A supporting member (or frame) 130 is formed to support the brush module 140. The supporting member 130 is provided with a hook coupling portion (or hook) 138 at one side thereof. As the hook coupling portion 138 is manipulated, the supporting member 130 may be separated from the module mounting housing 112.

The supporting member 130 includes a first connection portion (or first connection plate) 133 and a second connection portion (or second connection plate) 134 spaced apart from each other. The first connection portion 133 is provided at a front side of the brush module 140, and the second connection portion 134 is provided at a rear side of the brush module 140. The brush module 140 is exposed to a space 135 between the first and second connection portions 133, 134, thereby cleaning a floor.

Figure 4:
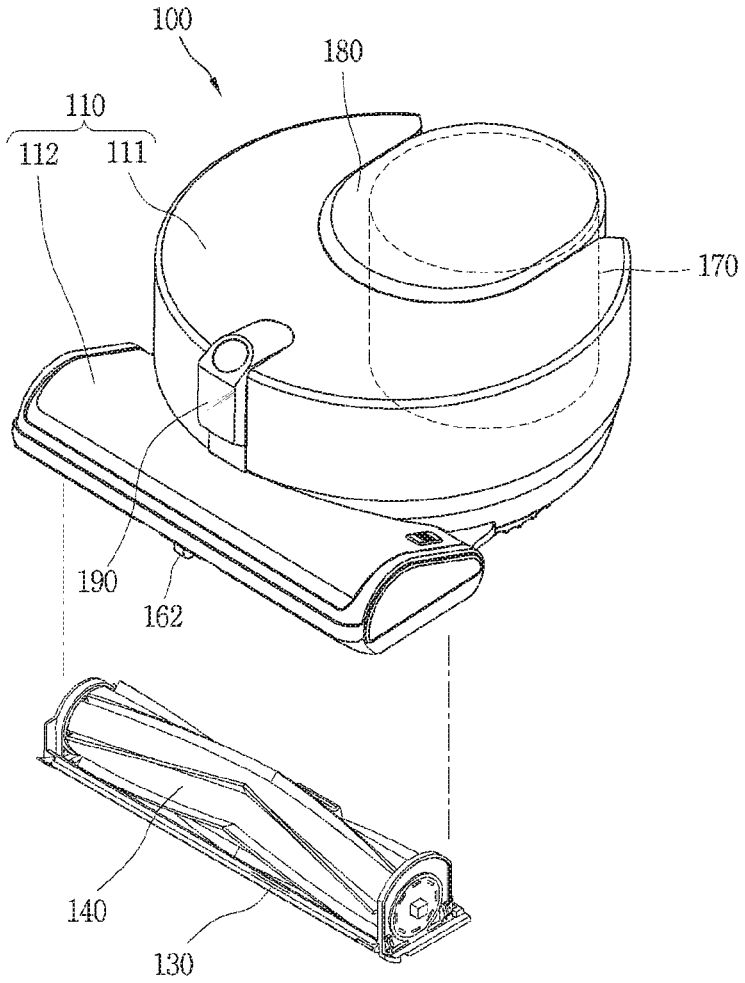
FIG. 4 is a conceptual view showing the cleaner body of FIG. 1, and a supporting member and a brush module separated from the cleaner body.

Next, the supporting member and the brush module will be explained. FIG. 4 is a conceptual view showing the cleaner body 110 of FIG. 1, and the supporting member 130 and the brush module 140 separated from the cleaner body 110.

The supporting member 130 and the brush module 140 are detachably mounted to the module mounting portion 110*a* (refer to FIG. 2) formed at a bottom part of the module mounting housing 112. More specifically, the brush module 140 is coupled to the supporting member 130, and the supporting member 130 is formed to be mountable to the module mounting portion 110*a*.

The supporting member 130 is inserted and mounted to the module mounting portion 110*a* through the bottom part of the module mounting housing 112. And the supporting member 130 is separated and withdrawn from the module mounting portion 110*a* through the bottom part (or lower surface) of the module mounting housing 112.

Since the brush module 140 is coupled to the supporting member 130, if the supporting member 130 is inserted and mounted to the module mounting portion 110*a*, the brush module 140 is also inserted and mounted to the module mounting portion 110*a* together with the supporting member 130. Likewise, if the supporting member 130 is separated and withdrawn from the module mounting portion 110*a*, the brush module 140 is also separated and withdrawn from the module mounting portion 110*a* together with the supporting member 130.

As shown in FIG. 4, the supporting member 130 and the brush module 140 are inserted and mounted to the module mounting portion in upper and lower directions (e.g., vertically). Accordingly, if the supporting member 130 and the brush module 140 are separated from the module mounting portion 110*a*, they may be withdrawn from the module mounting portion by their weight without an external force.

In the present disclosure, the brush module 140 is detachably coupled to the cleaner body 110 in a state that the supporting member 130 rotatably supports the brush module 140. However, the present disclosure is not limited to this. The brush module 140 may be directly detachably coupled to the cleaner body 110 without the supporting member 130. In this case, a structure corresponding to the supporting member 130 may be provided at the module mounting portion of the cleaner body 110.

Figure 5:
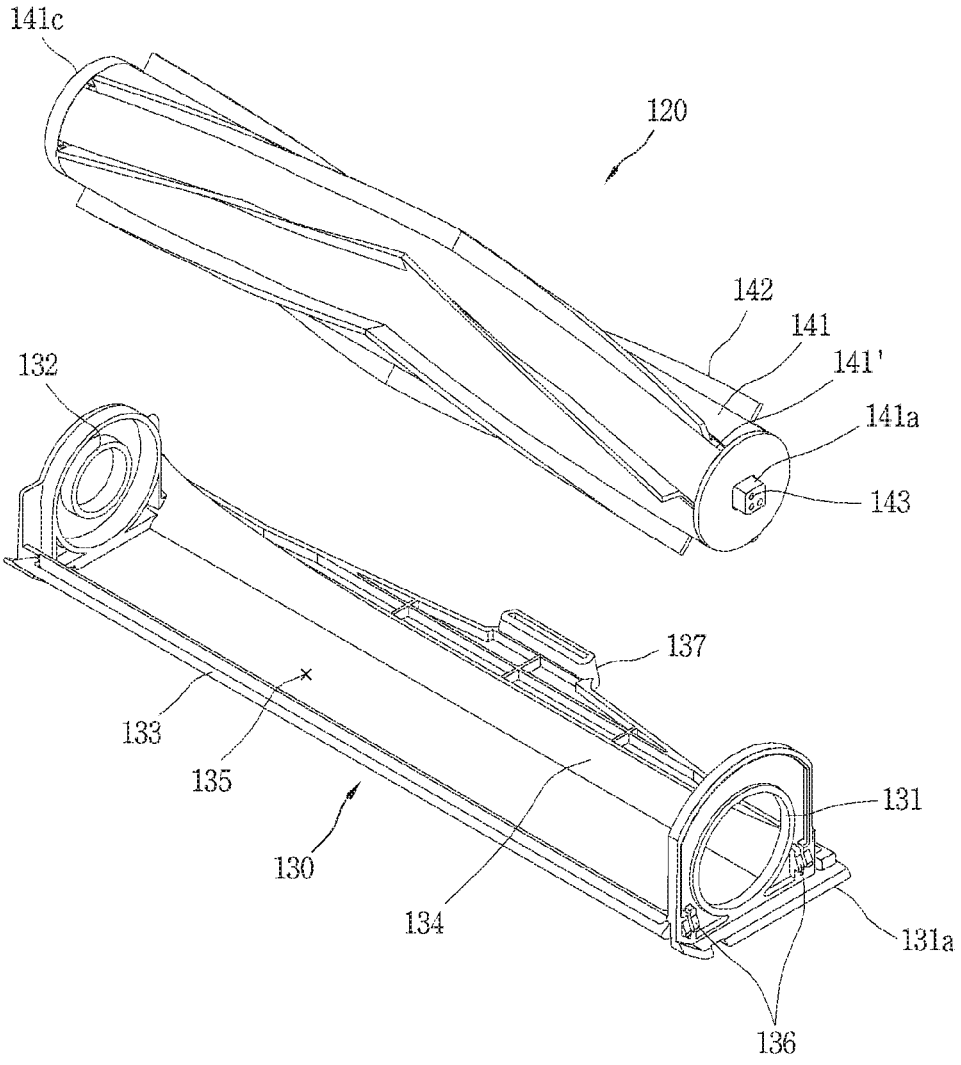
FIG. 5 is a disassembled perspective view of the supporting member and the brush module shown in FIG. 4.

FIG. 5 is a disassembled perspective view of the supporting member 130 and the brush module 140 shown in FIG. 4. The supporting member 130 is formed to rotatably support the brush module 140. The supporting member 130 includes a first supporting portion (or first supporting wall) 131, a second supporting portion (or second supporting wall) 132, the first connection portion 133, and the second connection portion 134.

The first and second supporting portions 131,132 are provided at both ends of the supporting member 130 so as to face each other. A separation distance between the first and second supporting portions 131, 132 may be equal to a length of a rotation rod 141 (or roller). The first and second supporting portions 131,132 enclose both ends of the rotation rod 141 so as to support the brush module 140 in a relatively rotatable manner. More specifically, the first supporting portion 131 encloses one end of the rotation rod 141, and the second supporting portion 132 encloses another end of the rotation rod 141.

The first and second connection portions 133,134 are configured to connect the first and second supporting portions 131,132 with each other. The first and second connection portions 133,134 may be spaced apart from each other at a front side and a rear side of the brush module 140. A brush (or blade) 142 of the brush module 140 is exposed to the space 135 between the first and second connection portions 133, 134, thereby cleaning a floor.

The supporting member 130 is detachably coupled to the module mounting portion 110*a* of the cleaner body 110. For the coupling, at least one hook 136 formed to be locked to the module mounting portion 110*a* (refer to FIGS. 1 and 7) may be provided at the supporting member 130. For instance, FIG. 5 shows that the hook 136 is formed at one end of the supporting member 130.

The hook 136 protrudes from an outer side surface of the first supporting portion 131. Once the supporting member 130 is inserted into the module mounting portion 110*a*, the hook 136 is locked by a protrusion (not shown) formed on an inner side surface of the module mounting portion. With such a configuration, the hook 136 prevents any separation of the supporting member 130.

A protruding portion (or support protrusion) 137 protruding in an insertion direction of the supporting member 130 is formed at a rear side of the second connection portion 134. The protruding portion 137 protrudes towards the inside of the module mounting portion 110*a*. Once the robot cleaner 100 (refer to FIG. 1) moves forward, the first and second connection portions 133,134 continuously receive an external force in a rear side of the robot cleaner. Here, the first connection portion 133 may be supported by the brush module 140, since the brush module 140 is coupled to a rear side of the first connection portion 133. However, the second connection portion 134 may be damaged by a continuous external force, because the brush module 140 is not provided at a rear side of the second connection portion 134. To prevent this, the protruding portion 137 is formed to support the second connection portion 134.

A groove (not shown) corresponding to the protruding portion 137 is formed on an inner side surface of the module mounting portion 110*a*, and the protruding portion 137 is inserted into the groove. The protruding portion 137 protrudes in an insertion direction of the supporting member 130, and a moving direction of the robot cleaner crosses the insertion direction. Accordingly, the protruding portion 137 may fix a position of the second connection portion 134 by preventing a movement of the second connection portion 134 in right and left directions and in upper and lower directions. This may prevent damage of the second connection portion 134.

The brush module 140 includes the rotation rod (or cylinder) 141 and the brush 142. The rotation brush 141 is formed to extend in one direction (e.g., an axial direction). A rotation shaft of the rotation rod 141 may be provided to be perpendicular to a forward driving direction of the cleaner body 110. The rotation rod 141 is configured to be connected to a rotation driving portion (or driving gear) 110*b* (refer to FIG. 7) when mounted to the cleaner body 110, and to be rotatable in at least one direction.

The rotation rod 141 is rotatably supported by the supporting member 130. The rotation rod 141 is formed to be rotatable in a restricted state to the supporting member 130. Accordingly, a rotation position of the rotation rod 141 may be fixed by the supporting member 130.

A rotation coupling member (or rotation coupling button) 141*a* is provided at one end of the rotation rod 141. The rotation coupling member 141*a* is exposed to the outside through one end of the rotation rod 141 in an axial direction. When the brush module is mounted to the module mounting portion of the cleaner body, the rotation coupling member 141*a* is coupled to the rotation driving portion 110*b* (refer to FIG. 7). With such a configuration, when the rotation driving portion 110*b* is driven, the rotation coupling member 141*a* transmits a driving force to the rotation rod 141 from the rotation driving portion 110*b*.

The rotation coupling member 141*a* is exposed to the outside through one end of the rotation rod 141, and is formed to be pressed toward the inside of the rotation rod 141. The rotation coupling member 141*a* receives an elastic force by an elastic member (or spring) 141*b* (refer to FIG.

7) to be explained later. Accordingly, even if the rotation coupling member 141*a* is pressed toward the inside of the rotation rod 141, the rotation coupling member 141*a* is restored to an initial position if an external force is removed.

If the separation distance between the first and second supporting portions 131, 132 is equal to the length of the rotation rod 141, it may be difficult to couple the brush module 140 to the supporting member 130 due to the rotation coupling member 141*a*. The reason is because the rotation coupling member 141*a* protrudes from one end of the rotation rod 141. However, since the rotation coupling member 141*a* can be pressurized, a difficulty in coupling the brush module 140 and the supporting member 130 with each other may be solved.

A rotation supporting portion (or bearing) 141*c* is installed at another end of the rotation rod 141. The rotation supporting portion 141*c* may have an outer circumferential surface formed as a curved surface so as to be rotatable in a restricted state to the second supporting portion 132 of the supporting member 130. The rotation supporting portion 141*c* may include a bearing 141*c*' (refer to FIG. 7).

The rotation supporting portion 141*c* is supported by the second supporting portion 132 of the supporting member 130 so as to be relatively rotatable. More specifically, the outer circumferential surface of the rotation supporting portion 141*c* is enclosed by the second supporting portion 132. As the rotation supporting portion 141*c* is supported by the second supporting portion 132, the rotation shaft of the rotation rod 141 may be provided to be aligned with a rotation shaft of the rotation driving portion 110*b*.

For reference, if the rotation rod 141 is directly mounted to the module mounting portion 110*a* without the supporting member 130, a rotation supporting portion for rotatably supporting the rotation rod 141 may be additionally formed at the module mounting portion 110*a*.

As aforementioned, the rotation rod 141 may be rotatably mounted to the supporting member 130. In the drawings, the first supporting portion 131 is provided with a through hole for inserting the rotation rod 141, and the rotation coupling member 141*a* protrudes from one end of the rotation rod 141 exposed to the outside via the through hole.

The brush 142 is coupled to an outer circumferential surface of the rotation rod 141. A groove 141' is formed at the outer circumferential surface of the rotation rod 141, and the brush 142 may be inserted into the groove 141' in a lengthwise direction of the rotation rod 141.

The brush 142 may be provided to form an acute angle at a middle region of the rotation rod 141 in order to collect dust at the middle region. The reason is because a suction force of a suction motor provided from the cleaner body is the largest at the middle region of the rotation rod 141.

The brush 142 is configured to clean a floor by being rotated together with the rotation rod 141 when the rotation rod 141 is rotated. The brush 142 is an example of the cleaning member. Accordingly, the brush 142 may be replaced by another cleaning member such as a mop. A user may replace the cleaning member or the cleaning module by selection.

The brush module 140 may further include a contact terminal 143. FIG. 5 shows that the contact terminal 143 is formed on a surface of the rotation coupling member 141*a* exposed to the outside through one end of the rotation rod 141. However, the position of the contact terminal 143 is not limited to this. The contact terminal 143 may be formed on any position where it may contact a contact switch 110*c* (refer to FIG. 7) of the cleaner body as the brush module 140 and the cleaner body are coupled to each other.

If the contact terminal 143 is formed on the surface of the rotation coupling member 141*a*, the rotation driving portion 110*b* (refer to FIG. 7) is provided with the contact switch 110*c* at a contact position with the contact terminal 143. Accordingly, if the brush module 140 is mounted to the cleaner body 110 (refer to FIG. 1), the rotation coupling member 141*a* of the rotation rod 141 is inserted into the rotation driving portion 110*b*. And the contact terminal 143 formed on the surface of the rotation coupling member 141*a* naturally contacts the contact switch 110*c*. The reason is because the rotation coupling member 141*a* receives an elastic force from the elastic member 141*b* (refer to FIG. 7).

The controller (e.g., printed circuit board 113) of the robot cleaner may recognize a type of the cleaning module mounted to the module mounting portion, according to the number of the contact terminals 143 contacting the contact switch 110*c*. For instance, FIG. 5 shows that the contact terminal 143 is provided in 3 in number, and FIG. 6 to be explained later shows that a contact terminal 153 is provided in 2 in number. Accordingly, if the number of the contact terminal contacting the contact switch is 3, the controller may recognize the cleaning module as the brush module 140. On the other hand, if the number of the contact terminal contacting the contact switch is 2, the controller may recognize the cleaning module as the mop module 150 (refer to FIG. 6).

The controller selects a cleaning algorithm of the robot cleaner based on a recognized type of the cleaning module 120. For instance, if the cleaning module 120 is recognized as the brush module 140, the controller may rotate the brush module 140 and drive the suction motor and a fan, thereby generating a suction force. On the other hand, if the cleaning module is recognized as the mop module 150, the controller may rotate only the mop module without performing a dust suction operation.

Figure 6:
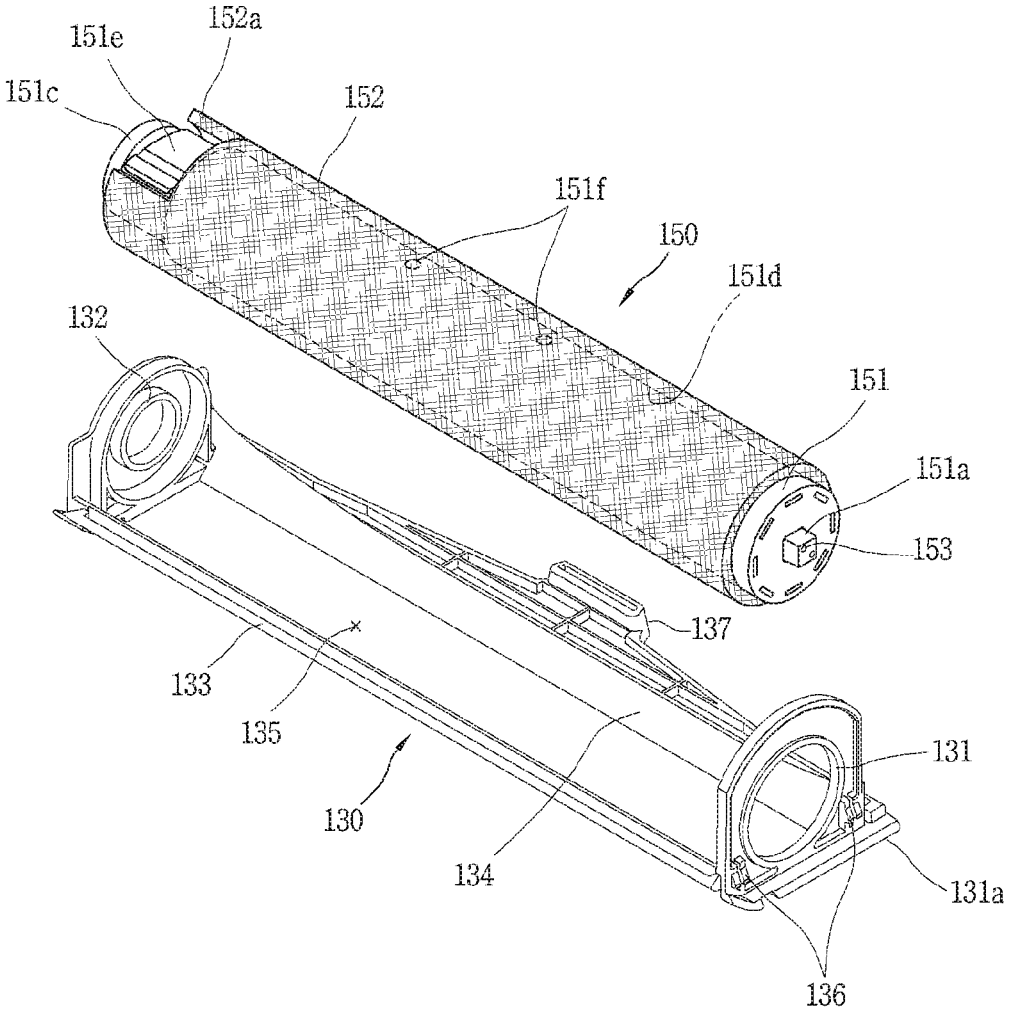
FIG. 6 is a disassembled perspective view of the supporting member and a mop module.

Hereinafter, the mop module will be explained as another example of the cleaning module. FIG. 6 is a disassembled perspective view of the supporting member 130 and the mop module 150. Explanations about the supporting member 130 will be replaced by those shown in FIG. 5, and only the mop module 150 will be explained. Explanations about the mop module 150 will be omitted if they are the same as those about the brush module 140.

A water accommodating portion 151*d* is formed in a rotation rod 151. A cover 151*e* (or a lid) through which water inside the water accommodating portion 151*d* is injected is formed on an outer circumferential surface of the rotation rod 151. If a user is to supplement water into the water accommodating portion 151*d*, the user may open the cover 151*e* to inject water into the water accommodating portion 151*d*.

Water discharge openings 151*f* communicated with the water accommodating portion 151*d* are formed on an outer circumference of the rotation rod 151. Water filled in the water accommodating portion 151*d* is discharged out through the water discharge openings 151*f*.

The water discharge opening 151*f* may be provided in plurality, and the plurality of water discharge openings 151*f* may be spaced apart from each other with a predetermined interval therebetween. In the drawings, the water discharge openings 151*f* are spaced apart from each other with a predetermined interval therebetween, in a lengthwise direction and a circumferential direction of the rotation rod 151. Alternatively, the water discharge openings 151*f* may be long extended in a lengthwise direction of the rotation rod 151.

All cleaning modules are compatible with each other. Accordingly, the mop module 150 is also mounted to the module mounting portion 110*a* (refer to FIG. 7) like the brush module 140 (refer to FIG. 5), and is rotatable as the rotation driving portion 110*b* (refer to FIG. 7) is driven. Accordingly, a centrifugal force is applied to the rotation rod 151 when the mop module 150 is rotated.

The water discharge opening 151*f* may have a preset size such that water filled in the water accommodating portion 151*d* may be discharged out through the water discharge openings 151*f* by a centrifugal force only when the mop module 150 is rotated. That is, water filled in the water accommodating portion 151*d* may not be discharged out through the water discharge openings 151*f* when the cleaning module 120 is not rotated.

The rotation rod 151 of the mop module 150 is provided with the contact terminal 153 on the same position as the rotation rod 141 of the brush module 140. However, the number of the contact terminals 153 provided at the rotation rod 151 of the mop module 150 is different from the number of the contact terminals 143 provided at the rotation rod 141 of the brush module. The reason is because the controller of the robot cleaner recognizes a type of the cleaning module based on the number of the contact terminal 153 contacting the contact switch 110*c* (refer to FIG. 7), which is explained with reference to the aforementioned FIG. 5.

If the brush module 140 and the mop module 150 are generalized as a first type cleaning module and a second type cleaning module, the cleaning module of the robot cleaner selectively includes the first type cleaning module and the second type cleaning module which are mountable to the supporting member. A rotation rod of the first type cleaning module and a rotation rod of the second type cleaning module are provided with a different number of contact terminals on the same position.

The robot cleaner is provided with a contact switch at a position where the contact switch contacts the contact terminal 153. The controller of the robot cleaner recognizes a type of the cleaning module coupled to the module mounting portion based on the number of the contact terminal contacting the contact switch. Then, a cleaning algorithm of the robot cleaner is selected based on the recognized type of the cleaning module.

Especially, the contact terminals 153 are preferably arranged to have the same distance from the center of a rotation coupling member 151*a*, such that contact positions between the contact terminals 153 and the contact switches are the same. The reason is because the contact switch contacts the contact terminal 153 regardless of an insertion angle of the rotation coupling member 151*a* into the rotation driving portion.

A mop 152 is formed to enclose an outer circumference of the rotation rod 151. The mop 152 is an example of the cleaning member. If the mop 152 is coupled to the rotation rod 151, the cleaning module is sorted as the mop module 150.

The mop 152 may be formed not to cover the cover 151*e*. In the drawings, the mop 152 is provided with a cut-out portion 152*a* corresponding to the cover 151*e*. Since the cover 151*e* is exposed to the outside without being covered by the mop 152, a user can inject water into the water accommodating portion 151*d* without separating the mop 152 from the rotation rod 151.

As shown, the mop 152 may be provided with a hollow portion corresponding to the rotation rod 151, and may be formed in a cylindrical shape having both ends open in a lengthwise direction. Alternatively, the mop 152 may be formed to be wound on an outer circumference of the rotation rod 151 and then to have its both ends attached with Velcro or other attaching mechanism. The mop 152 may be formed to cover the water discharge openings 151*f* so as to be soaked by water discharged from the water discharge openings 151*f*.

The mop 152 may be formed of a soft textile material. Alternatively, the mop 152 may be formed such that a soft textile material may be formed on a base member formed of a hard material so as to maintain a shape. In this case, the base member is formed to enclose an outer circumference of the rotation rod 151, and is formed such that water discharged from the water discharge openings 151*f* passes therethrough.

In FIG. 6, unexplained reference numeral 151*c* denotes a rotation supporting portion corresponding to the rotation supporting portion 141*c*.

Figure 7:
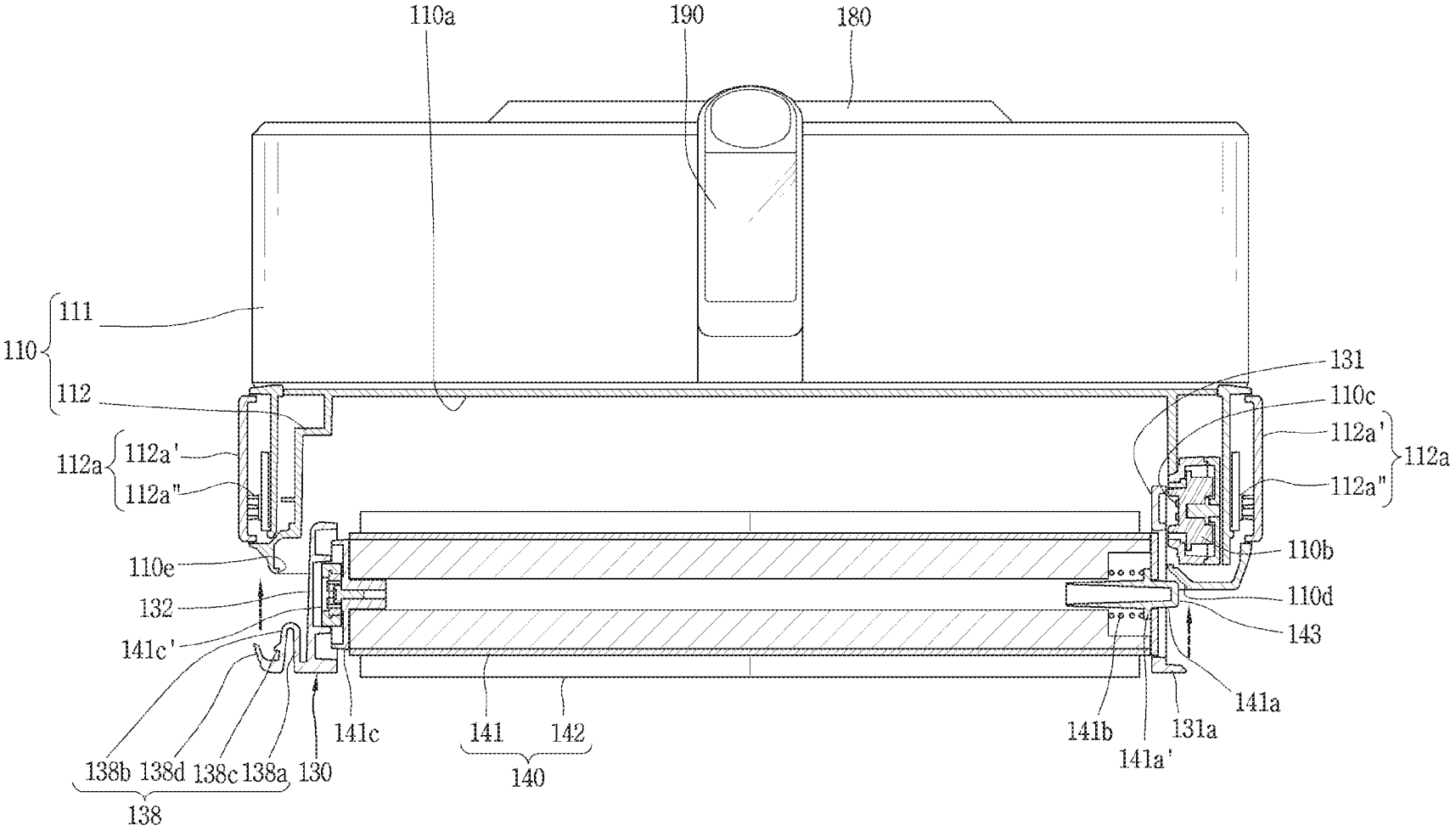
FIG. 7 is a conceptual view showing a process of mounting a brush module to a cleaner body.
Figure 8:
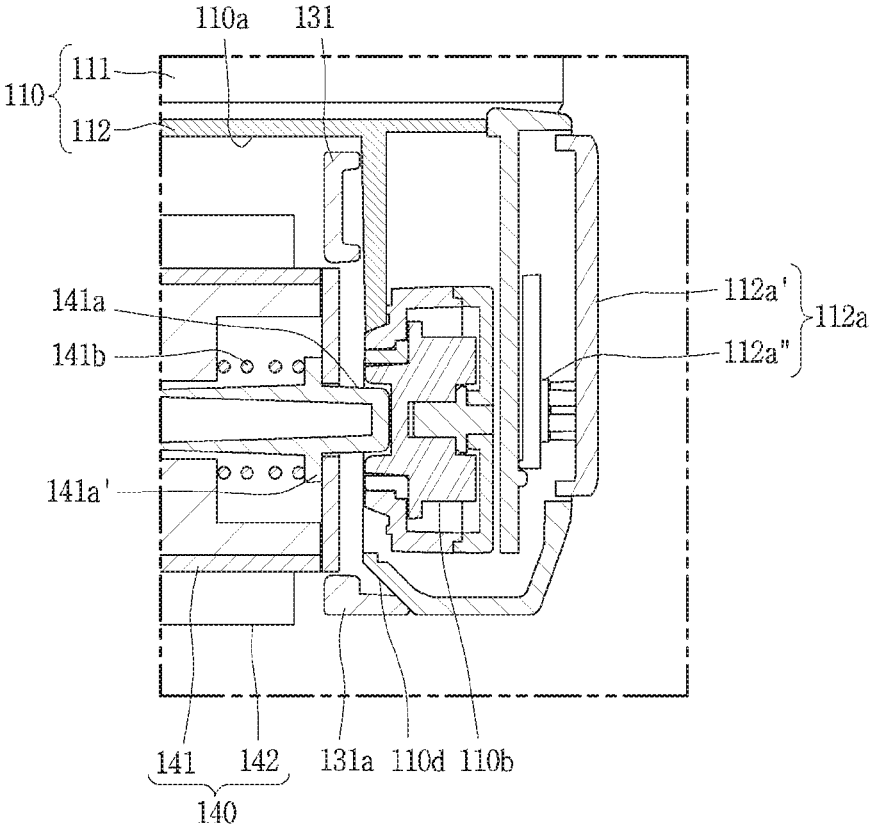
FIG. 8 is a sectional view taken along line 'B-B' in FIG. 1.
Figure 9:
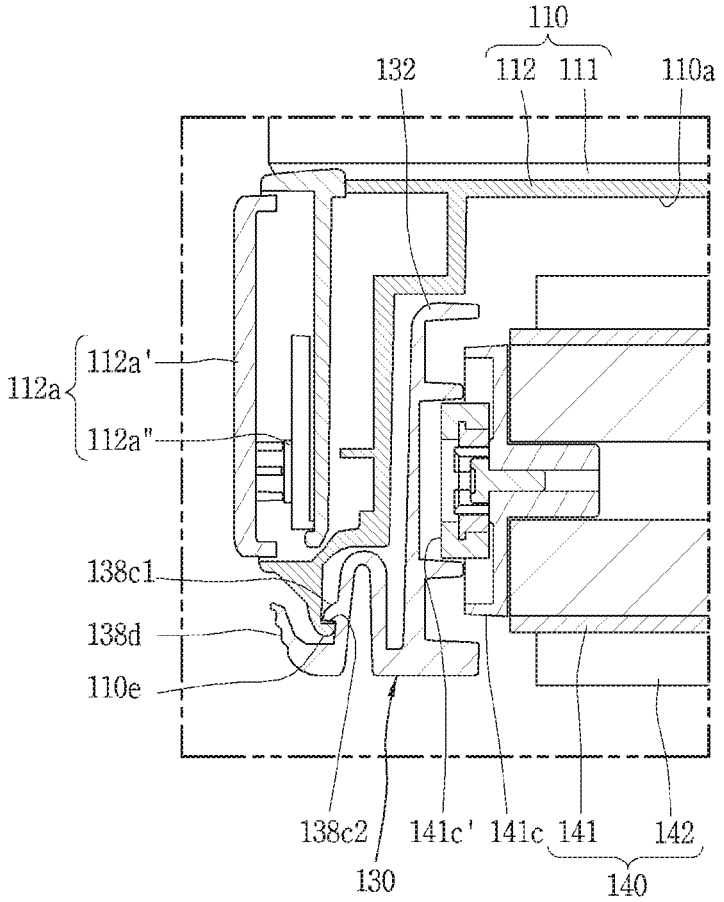
FIG. 9 is a sectional view taken along line 'C-C' in FIG. 1.

Next, a mounting structure of the supporting member and the brush module will be explained. FIG. 7 is a conceptual view showing a process of mounting the brush module 140 to the cleaner body 110, FIG. 8 is a sectional view taken along line 'B-B' in FIG. 1, and FIG. 9 is a sectional view taken along line 'C-C' in FIG. 1. FIGS. 8 and 9 show a mounted state of the supporting member and the brush module 140 to the module mounting portion 110*a*. Hereinafter, only components not explained in the aforementioned figures will be explained, and a process of mounting the brush module 140 to the cleaner body 110 will be explained.

As aforementioned, the rotation coupling member 141*a* is formed to be pressed towards the inside of the rotation rod 141. The rotation rod 141 further includes an elastic member (or spring) 141*b*, and the elastic member 141*b* provides an elastic force such that the rotation coupling member 141*a* pressed towards the inside of the rotation rod 141 is restored to an initial position. The initial position means a state before the rotation coupling member 141*a* is pressed towards the inside of the rotation rod 141 by an external force, or a position in a state that an external force applied to the rotation coupling member 141*a* is removed.

The rotation coupling member 141*a* is provided with a separation prevention portion (or radial wall) 141*a*' on an outer circumferential surface thereof. The separation prevention portion 141*a*' protrudes along the outer circumferential surface of the rotation coupling member 141*a*. Since a hole of the rotation rod 141 through which the rotation coupling member 141*a* is exposed is smaller than that of the separation prevention portion 141*a*', the separation prevention portion 141*a*' may prevent the rotation coupling member 141*a* from being separated from the rotation rod 141. Referring to FIG. 7, the elastic member 141*b* is formed to pressurize the separation prevention portion 141*a*'.

The rotation driving portion 110*b* is provided at one side of the module mounting portion 110*a*. The position of the rotation driving portion 110*b* corresponds to the position of the rotation coupling member 141*a* of the rotation rod 141. Accordingly, in a mounted state of the brush module 140 to the module mounting portion 110*a*, the rotation coupling member 141*a* is pressurized by an elastic force provided from the elastic member 141*b*, thereby being inserted into the rotation driving portion 110*b*.

An inclined surface 110*d* is formed at an inlet of the module mounting portion 110*a*. The position of the inclined surface 110*d* is a contact position with the rotation coupling member 141*a* in a process of mounting the brush module 140. Accordingly, in the process of mounting the brush module 140, the rotation coupling member 141*a* may slide along the inclined surface 110*d* to thus be pressurized towards the inside of the rotation rod 141. The inclined surface 110*d* is formed to be closer to the rotation coupling member 141*a* as it is towards the inside of the module mounting portion 110*a*. Accordingly, during a mounting process of the brush module 140, the rotation coupling member 141*a* may be gradually pressurized towards the inside of the rotation rod 141 by the inclined surface 110*d*.

With regards to another end of the rotation rod 141, the rotation supporting portion 141*c* is provided with a bearing 141*c*'. The bearing 141*c*' is exposed to the outside through another end of the rotation rod 141. The second supporting portion 132 of the supporting member 130 encloses an outer circumferential surface of the bearing 141*c*', and the second supporting portion 132 encloses the rotation supporting portion 141*c* at an outer periphery of the bearing 141*c*'. Accordingly, the rotation rod 141 is rotated in a restricted state to the second supporting portion 132.

The supporting member 130 is provided with a hook coupling portion (or hook) 138 so as to be prevented from being arbitrarily separated from the module mounting portion 110*a*. The hook coupling portion 138 is locked to a protrusion 110*e* (or ledge) of the module mounting portion 110*a*. Referring to FIG. 7, the protrusion 110*e* protrudes from an inlet of the module mounting portion 110*a* towards the supporting member 130. The hook coupling portion 138 includes a first part (or first wall) 138*a*, a second part (or second wall) 138*b*, a locking protrusion (or latch) 138*c* and a manipulation portion (or manipulation contact surface) 138*d*.

The first part 138*a* protrudes from one end of the supporting member 130 towards the inside of the module mounting portion 110*a*. Referring to FIG. 7, a direction of the inside of the module mounting portion 110*a* means an upward direction. The second part 138*b* is bent from the first part 138*a*, and protrudes towards the outside of the module mounting portion 110*a*. Referring to FIG. 7, a direction of the outside of the module mounting portion 110*a* means a downward direction.

As the first and second parts 138*a*, 138*b* have different protruding directions from each other, a bending stress occurs between the first and second parts 138*a*, 138*b* by an external force. The bending stress means a resistive force occurring from the inside of a material as a bending moment is applied to the material. Accordingly, the first and second parts 138*a*, 138*b* have a property to restore a state before the external force is applied.

The manipulation portion 138*d* protrudes from the end of the second part 138*b* so as to manipulate the hook coupling portion 138. Since the manipulation portion 138*d* is exposed to the outside through a bottom part of the cleaner body 110, it can be manipulated by a user's finger.

The locking protrusion 138*c* protrudes from a middle region of the second part 138*b* towards the protrusion 110*e*, so as to be locked to the protrusion 110*e*. Accordingly, if the supporting member 130 is inserted into the module mounting portion 110*a*, the locking protrusion 138*c* is locked to the protrusion 110*e* of the module mounting portion 110*a*. Arbitrary separation of the supporting member 130 may be prevented by the locking protrusion 138*c* and the protrusion 110*e*. The locking protrusion 138*c* includes an inclined surface (or ramp) 138*c*1 and a locking surface (or ledge) 138*c*2.

The inclined surface 138*c*1 contacts the protrusion 110*e* during an insertion process of the supporting member 130, and is formed to be slidable along the surface of the protrusion 110*e*. With such a configuration, the inclined surface 138*c*1 contacts the protrusion 110*e* and passes through the protrusion 110*e* during an insertion process of the supporting member 130.

The locking surface 138*c*2 is formed at an opposite side to the inclined surface 138*c*1. The locking surface 138*c*2 is formed to be locked to the protrusion 110*e* in a mounted state of the supporting member 130 to the module mounting portion 110*a*. Preferably, the protrusion 110*e* protrudes towards the inside of the module mounting portion 110*a* in order to prevent arbitrary release of a locked state, and the locking surface 138*c*2 is formed to plane-contact the protrusion 110*e*.

In a mounted state of the supporting member 130 to the module mounting portion 110*a*, the manipulation portion 138*d* is spaced apart from the cleaner body 110 so as to be pressurized. Referring to FIG. 7, the cleaner body 110 means a rear surface of the protrusion 110*e*. If the manipulation portion 138*d* is adhered to the rear surface of the protrusion 110*e*, it is impossible to release a locked state of the locking protrusion 138*c* and the protrusion 110*e* by pressing the manipulation portion 138*d*.

In order to mount the supporting member 130 and the brush module 140 to the module mounting portion 110*a*, the supporting member 130 and the brush module 140 are coupled to each other. Then, the supporting member 130 and the brush module 140 are inserted into the module mounting portion 110*a* through a bottom part of the cleaner body 110. During the mounting process of the supporting member 130 and the brush module 140, the rotation coupling member 141*a* of the rotation rod 141 contacts the inclined surface 110*d*, and the hook coupling portion 138 of the supporting member 130 contacts the protrusion 110*e*.

During the mounting process of the brush module 140, the rotation coupling member 141*a* contacting the inclined surface 110*d* is slid along the inclined surface 110*d*. As the brush module 140 is inserted into the module mounting portion 110*a*, the rotation coupling member 141*a* is gradually pressurized towards the inside of the rotation rod 141 by the inclined surface 110*d*. If the brush module 140 is inserted into the module mounting portion 110*a*, the rotation coupling member 141*a* passes through an inner plane of the module mounting portion 110*a* via the inclined surface 110*d*. While passing through the inner plane of the module mounting portion 110*a*, the rotation coupling member 141*a* maintains a pressed state towards the inside of the rotation rod 141 by the inner plane.

The rotation driving portion 110*b* is formed to accommodate the rotation coupling member 141*a* therein. If the brush module 140 is continuously inserted into the module mounting portion 110*a*, the rotation coupling member 141*a* reaches a position where it faces the rotation driving portion 110*b*. Here, the rotation coupling member 141*a* is restored to an initial position by an elastic force provided from the elastic member 141*b*, thereby being inserted into the rotation driving portion 110*b*.

While the rotation coupling member 141*a* is inserted into the rotation driving portion 110*b*, the hook coupling portion 138 is coupled to the protrusion 110*e*. While the supporting member 130 is inserted into the module mounting portion 110*a*, the locking protrusion 138*c* of the hook coupling portion 138 contacts the protrusion 110*e* of the module mounting portion 110*a*, and is pressurized by the protrusion 110*e*. The locking protrusion 138*c* and the second part 138*b* are pressurized towards the first part 138*a* by the protrusion 110*e*. If the supporting member 130 is inserted into the module mounting portion 110*a* more deeply by an additional force, the inclined surface 110*d* of the locking protrusion

138*c* overcomes a resistive force to the protrusion, and the locking protrusion 138*c* is locked to the protrusion 110*e*.

FIGS. 8 and 9 show a mounted state of the supporting member 130 and the brush module 140 to the module mounting portion 110*a*. The supporting member 130 is provided with a shield 131*a* at a lower end of the first supporting portion 131. A space between the supporting member 130 and the module mounting portion 110*a* may be exposed to the outside by the inclined surface 110*d* formed at the module mounting portion 110*a*. However, the shield 131*a* protrudes from one end of the supporting member 130 to block the space. This may prevent foreign materials such as dust from being accumulated in the space.

As aforementioned, if the brush module 140 is completely mounted, the contact terminal 143 (refer to FIG. 5) of the brush module 140 contacts the contact switch 110*c* provided at the rotation driving portion 110*b*.

Figure 10:
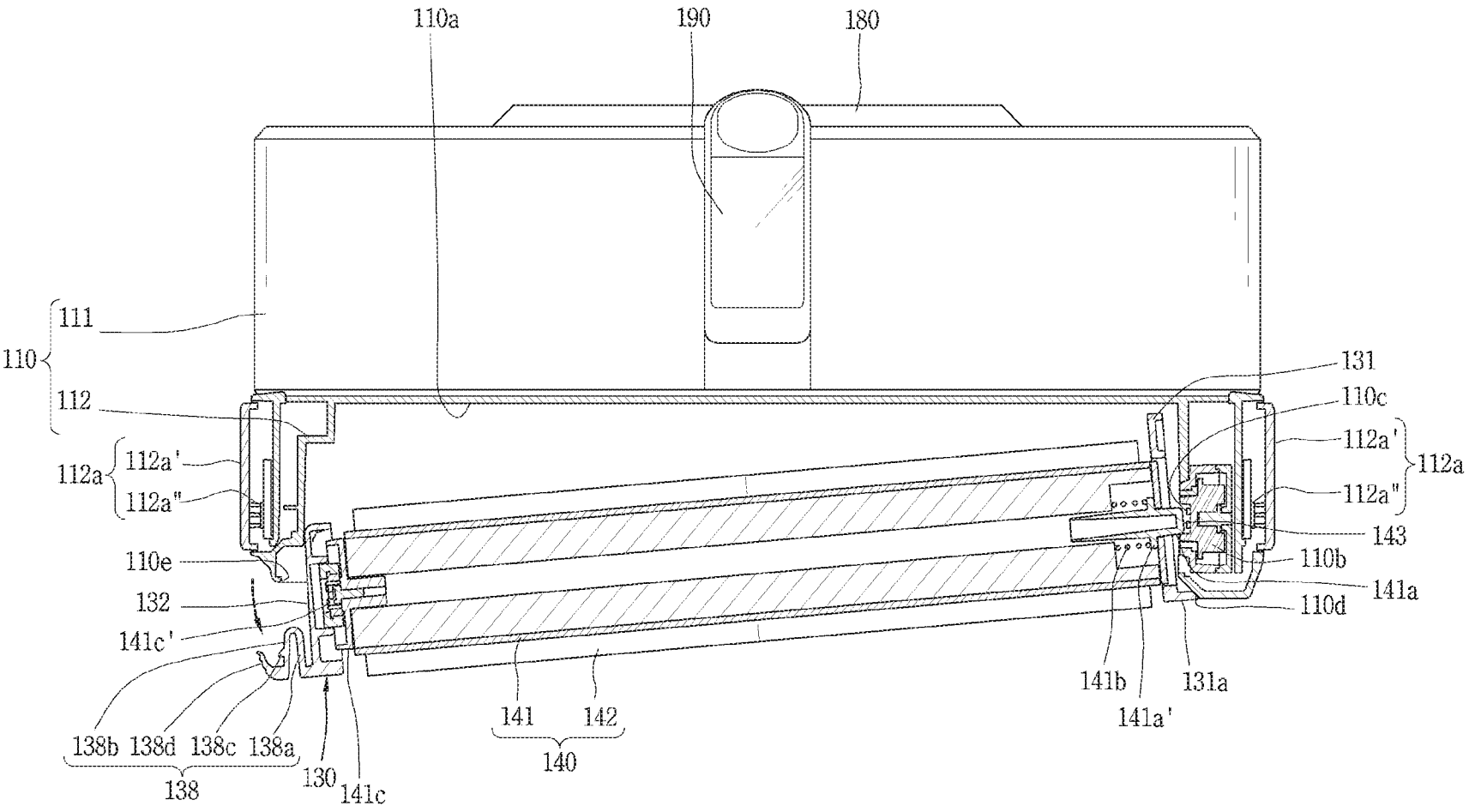
FIG. 10 is a conceptual view showing a process of separating a brush module from a cleaner body.

Next, a separation structure of the supporting member and the brush module will be explained. FIG. 10 is a conceptual view showing a process of separating the brush module 140 from the cleaner body 110. The process of separating the brush module 140 from the cleaner body 110 may be understood to be opposite to the mounting process.

If the manipulation portion 138*d* of the hook coupling portion 138 is pressurized in an axial direction of the rotation rod 141, the second part 138*b* and the locking protrusion 138*c* are pushed towards the first part 138*a*. Accordingly, the coupled state between the protrusion 110*e* and the locking protrusion 138*c* is released, and thus the hook coupling portion 138 becomes a free end.

If the coupled state between the protrusion 110*e* and the locking protrusion 138*c* is released, the supporting member 130 and the brush module 140 are tilted on the basis of the rotation coupling member 141*a* to thus be separated from the module mounting portion 110*a*. If the supporting member 130 and the brush module 140 are pulled in an axial direction of the rotation rod 141 in a state that the supporting member 130 and the brush module 140 are inclined from the original position, the supporting member 130 and the brush module 140 are withdrawn from the module mounting portion 110*a*.

In the present disclosure, the cleaning module 120 (refer to FIG. 2) is inserted and mounted to the module mounting portion 110*a* together with the supporting member 130, and is separated and withdrawn from the module mounting portion 110*a* together with the supporting member 130. This is advantageous in a sanitary aspect, because most of dust is accumulated on the cleaning module, and a user can mount or separate the cleaning module to or from the module mounting portion 110*a* by holding only the supporting member 130 without touching the cleaning module.

Further, since the supporting member 130 and the cleaning module are inserted and withdrawn at a bottom part of the cleaner body 110 in an upper and lower direction, convenience in mounting and/or separating the supporting member 130 and the cleaning module may be enhanced. For instance, if a user lifts the cleaner body 110 after pressurizing the manipulation portion 138*d* of the hook coupling portion 138, the supporting member 130 and the cleaning module may be separated from the module mounting portion 110*a* by their weight. Accordingly, in the present disclosure, inconvenience in overturning the cleaner body 110 may be solved.

Further, in the present disclosure, a type of the cleaning module is automatically recognized, and a cleaning algorithm is selected according to the recognized type of the cleaning module. This may enhance performance of the robot cleaner having an autonomous driving function and an automatic cleaning function.

Figure 11:
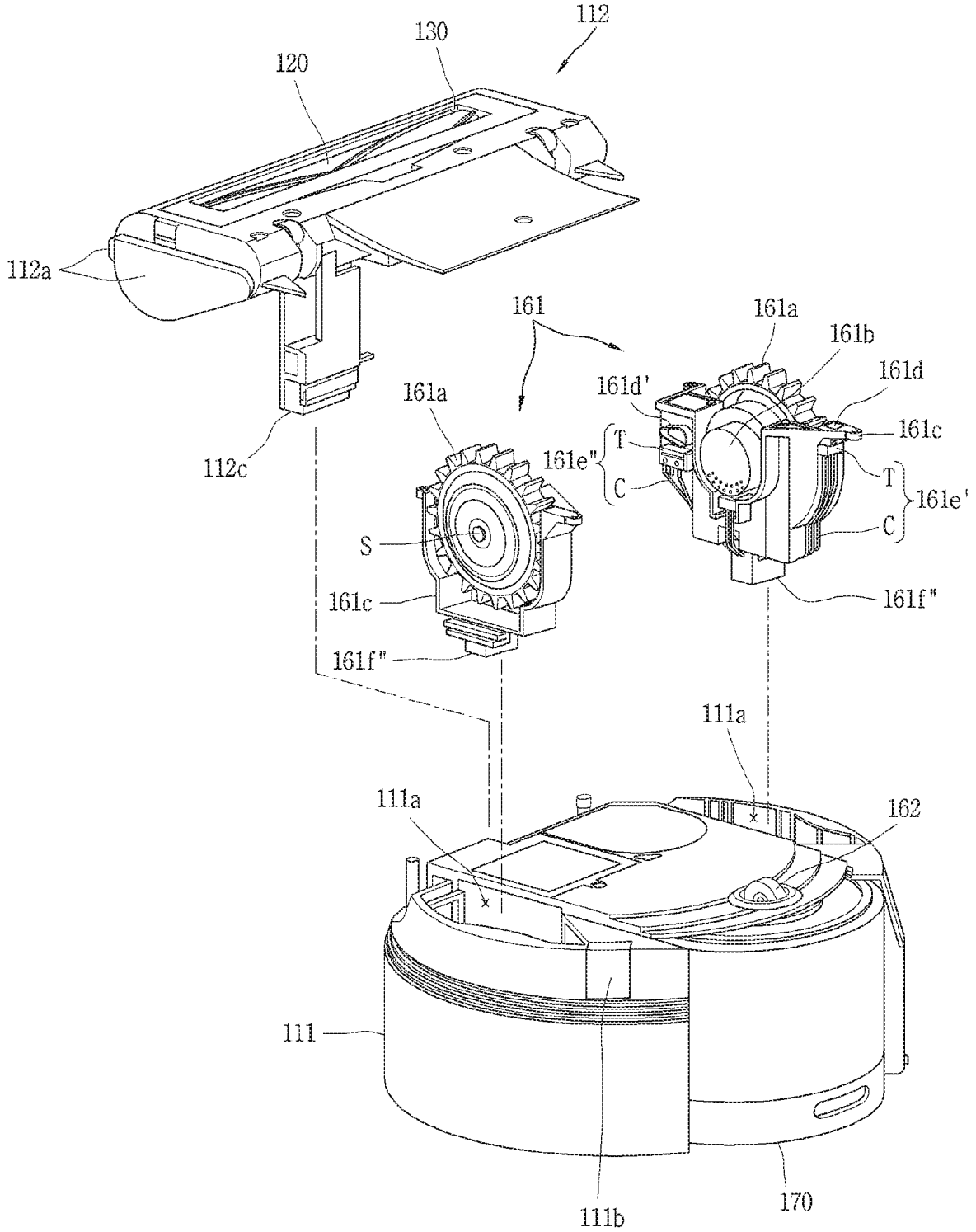
FIG. 11 is a disassembled perspective view of a main housing, a driving wheel, and a module mounting housing.
Figure 12:
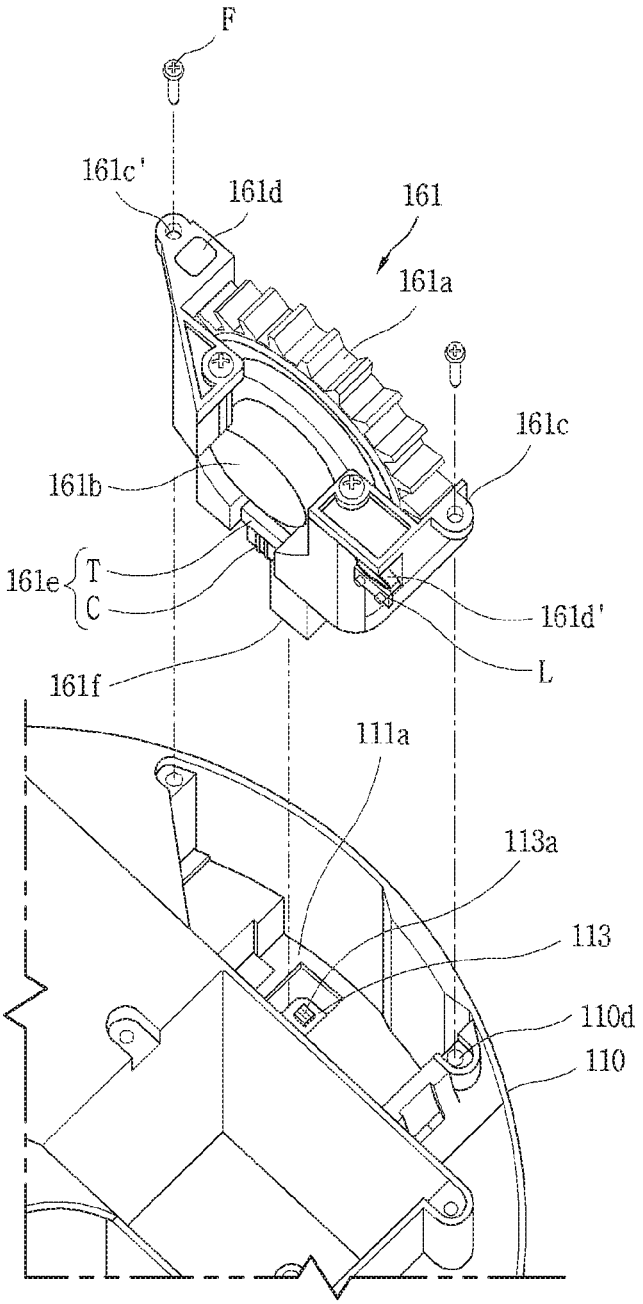
FIG. 12 is a conceptual view for explaining a physical and electrical coupling structure between a main housing and a driving wheel.

Next, a physical and electrical coupling structure of the driving wheels 161, the module mounting housing 112, etc. to the main housing 111 will be explained. FIG. 11 is a disassembled perspective view of the main housing 111, the driving wheel 161, and the module mounting housing 112, and FIG. 12 is a conceptual view for explaining a physical and electrical coupling structure between the main housing 111 and the driving wheel 161.

The driving wheel 161 and the module mounting housing 112 are formed as a module which can be coupled to and separated from the main housing 111. The module is a constituent unit of a machine, a system, etc., and means a set of components. As a plurality of electronic or mechanical components are assembled to each other, the module indicates an independent device having a specific function. As one module, the driving wheel 161 includes a main wheel 161*a*, a motor 161*b*, a wheel cover 161*c*, various types of sensors 161*d*, 161*d*', sub connectors 161*e*, 161*e*', 161*e*", and a main connector 161*f*".

Concavo-convex portions for enhancing a frictional force with a ground surface are formed on an outer circumferential surface of the main wheel 161*a*. If a frictional force between the main wheel 161*a* and the ground surface is not sufficient, the robot cleaner may slide from an inclined surface or may not move or rotate towards an intended direction. Accordingly, a sufficient frictional force should be obtained between the main wheel 161*a* and the ground surface.

Theoretically, a frictional force is unrelated to a contact area, and is variable according to a roughness of a contact surface and a weight of an object. Accordingly, if there are concavo-convex portions on the outer circumferential surface of the main wheel 161*a*, a sufficient frictional force can be obtained as a roughness of a contact surface is increased.

The motor 161*b* is coupled to an inner side surface of the main wheel 161*a*. A rotation shaft (S) of the motor 161*b* extends towards the main wheel 161*a* to thus be connected to a central region of the main wheel 161*a*. The motor 161*b* may be provided at each of the right and left driving wheels 161. Accordingly, the right and left driving wheels 161 may be driven independently.

The wheel cover 161*c* is formed to protect the main wheel 161*a*, to support the motor 161*b* and the sub connectors 161*e*, 161*e*', 161*e*", and to mount the driving wheel 161. The wheel cover 161*c* is formed to enclose at least part of the main wheel 161*a*. Referring to FIG. 11, the wheel cover 161*c* encloses an outer circumferential surface and an inner side surface of the main wheel 161*a*. The outer circumferential surface of the main wheel 161*a* is not enclosed by the wheel cover 161*c*, but is enclosed by the main housing 111. An inner circumferential surface of the wheel cover 161*c* is spaced apart from the main wheel 161*a* in order not to prevent a rotation of the main wheel 161*a*. When the driving wheel 161 has been mounted to the main housing 111, the wheel cover 161*c* is spaced apart from a ground surface. The wheel cover 161*c* is formed to support the motor 161*b*. A space (not shown) for mounting the motor 161*b* is provided at the wheel cover 161*c*, and the motor 161*b* coupled to the main wheel 161*a* is inserted into the space.

Referring to FIG. 12, a boss portion (or boss extension) 161*c*' may be formed at the wheel cover 161*c*. And a coupling member inserting hole 111*b* corresponding to the boss portion 161*c*' is formed at a bottom surface of the main housing 111. The driving wheel 161 is inserted into a space 111*a* provided at the bottom surface of the main housing 111.

If the boss portion 161c' is coupled to a coupling member (F) provided in the coupling member inserting hole 111b, the driving wheel 161 is mounted to the main housing 111.

Various types of sensors 161d, 161d' may be selectively installed at the driving wheel 161. FIG. 11 shows that a cliff sensor 161d and a wheel dropping sensor 161d' are installed at the wheel cover 161c. The cliff sensor 161d has been aforementioned. However, a position of the cliff sensor 161d may be variable according to a design. For instance, as shown in FIG. 11, the cliff sensor 161d may be installed at a bottom part of the wheel cover 161c.

The wheel dropping sensor 161d' may be installed at the wheel cover 161c. The wheel dropping sensor 161d' includes a link (L) and a switch (not shown) so as to sense a downward state of the main wheel 161a. If the main wheel 161a is downward moved from an initial position, the link (L) connected to the main wheel 161a is rotated to pressurize the switch. Then, the switch transmits a pressurization signal to the controller of the robot cleaner.

The wheel dropping sensor 161d' may be used to control a driving of the main wheel 161a, and to control the cleaner to avoid an obstacle. For instance, when a user lifts the robot cleaner, the right and left main wheels 161a are downward moved from an initial position. The controller may stop the driving of the right and left main wheels 161a based on the pressurization signal received from the switch.

If a pressurization signal is transmitted from one of the right and left main wheels 161a, the controller may rotate the main wheels 161a in an opposite direction. This is an operation to control the robot cleaner to avoid an obstacle when one of the main wheels 161a performs an idling as the cleaner body 110 collides with an obstacle.

The various types of sensors 161d, 161d' are electrically connected to the main connector 161f" by the sub connectors 161e, 161e', 161e". The sub connectors 161e, 161e', 161e" are configured to electrically connect various types of electronic components provided at the driving wheel 161 to the main connector 161f". Each of the sub connectors 161e, 161e', 161e" may include a cable (C) and a connection terminal (T). The cable (C) protrudes from the main connector 161f", and the connection terminal (T) is installed at the end of the cable (C). The wheel cover 161c may form an arrangement region of the cable (C), and may be provided with a cable holder (not shown) for fixing the cable (C).

FIG. 11 shows that the sub connectors 161e, 161e', 161e" are exposed to an outer surface of the wheel cover 161c. However, it is also possible to arrange the sub connectors 161e, 161e', 161e" so as to be covered by the wheel cover 161c.

The motor 161b or the sensors 161d, 161d', coupled to the wheel cover 161c, may be provided with a connection socket (not shown) for electrical connection. If the connection terminal (T) of each of the sub connectors 161e, 161e', 161e" is inserted into the connection socket, the motor 161b is electrically connected to the main connector 161f", and the sensors 161d, 161d' are electrically connected to the main connector 161f". When the components of the driving wheels 161 are connected to each other physically and electrically, the driving wheels 161 may be sorted as one module.

The main connector 161f" may protrude from the wheel cover 161c towards the inside of the main housing 111. The protruding direction of the main connector 161f" from the wheel cover 161c is the same as an insertion direction of the driving wheels 161 into the main housing 111. The space 111a for mounting the driving wheel 161 is provided at the main housing 111, and the driving wheel 161 is inserted into the space 111a. A main printed circuit board (PCB) 113 is mounted in the main housing 111, and one surface of the main PCB 113 is exposed to the outside through the space 111a for mounting the driving wheel 161.

A connection terminal 113a is provided at one surface of the main PCB 113, and the connection terminal 113a is provided at a position corresponding to the main connector 161f". And the main connector 161f" is formed to have a shape of a connection socket corresponding to the connection terminal 113a of the main PCB 113.

Accordingly, when the driving wheel 161 is inserted into the main housing 111, the connection terminal 113a of the main PCB 113 is inserted into the main connector 161f" having a shape of a connection socket, resulting in electrically connecting the main PCB 113 to the driving wheel 161. The positions of the connection terminal 113a and the connection socket may be interchanged with each other. Further, the coupling member (F) may be formed to couple the wheel cover 161c with the main housing 111.

Such a physical and electrical connection structure may be equally applied to a connection structure between the module mounting housing 112 and the main housing 111. FIG. 11 shows that a main connector 112c similar to the driving wheel 161 is provided at the module mounting housing 112.

The main connector 112c of the module mounting housing 112 is also electrically connected to various electronic components of the module mounting housing 112 through a sub connector (not shown). If the module mounting housing 112 is mounted to the main housing 111, the main connector 112c of the module mounting housing 112 may be coupled to a connection terminal (not shown) of the main PCB 113. A protruding direction of the main connector 112c from the module mounting housing 112 is the same as an insertion direction of the module mounting housing 112 into the main housing 111.

In the present disclosure, as the driving wheel 161, the module mounting housing 112, or the like is physically coupled to the main housing 111, it is electrically connected to the main housing 111. This may facilitate an assembly between each module and the main housing 111, and may prevent a secondary inferiority by preventing an influence on other module or components when each module is disassembled from the main housing 111.

Unlike the configuration of the present disclosure, if each module is primarily physically coupled to the main housing 111 and then is secondarily electrically connected to the main housing 111, a difficulty in assembly, i.e., a secondary inferiority may occur. Since a physical and electrical connection should be performed by a two-time process not by a single process, the number of assembly processes is increased. Further, in case of disassemble the robot cleaner with a primary inferiority, other module or component may be influenced, resulting in a secondary inferiority.

Especially, the physical and electrical connection structure of the present disclosure is advantageous to a massive production by automation. A production process of a modernized robot cleaner is precisely performed by a robot which is operated mechanically, and a man's inaccurate intervention is excluded during the production process.

If the physical and electrical connection structure of the present disclosure is applied to the robot cleaner, an assembly between the main housing 111 and each module may be completed by a single automation process. The assembly means not only a physical connection, but also an electrical connection. Since the protruding direction of the main connector 161f" is the same as the insertion direction of the driving wheels 161, a physical coupling direction and an electrical coupling direction between modules may be understood to be the same. Accordingly, the structure of the present disclosure is very advantageous to an automation process excluding a man's intervention.

Explanations about unexplained reference numerals of FIGS. 11 and 12 will be replaced by the aforementioned ones. Reference numeral 111*b* denotes a switch cover, and a power switch structure of the robot cleaner will be explained hereinafter.

Figure 13:
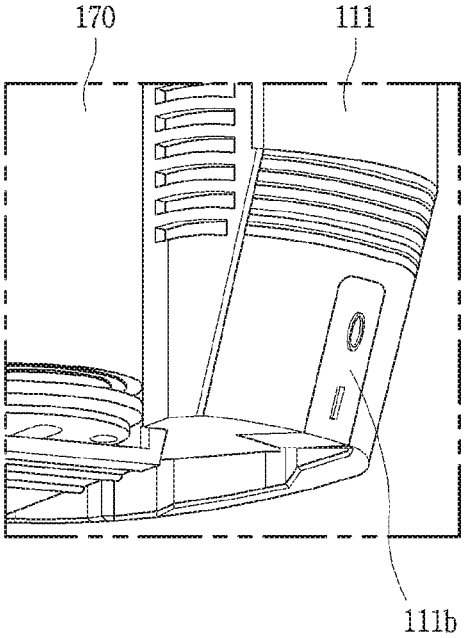
FIGS. 13 and 14 are conceptual views partially showing appearance of a main housing to which a switch cover is exposed.
Figure 14:
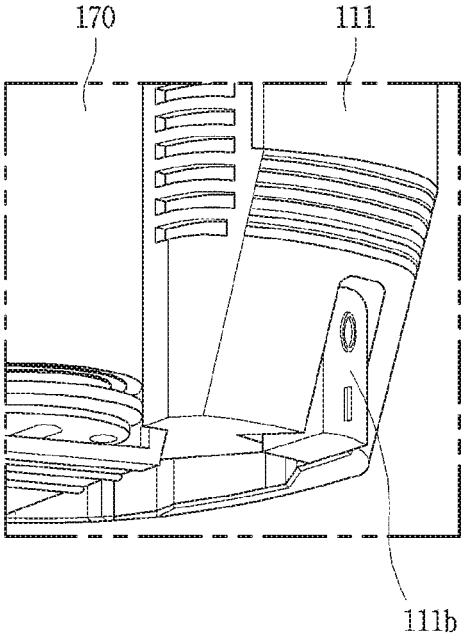
Figure 15:
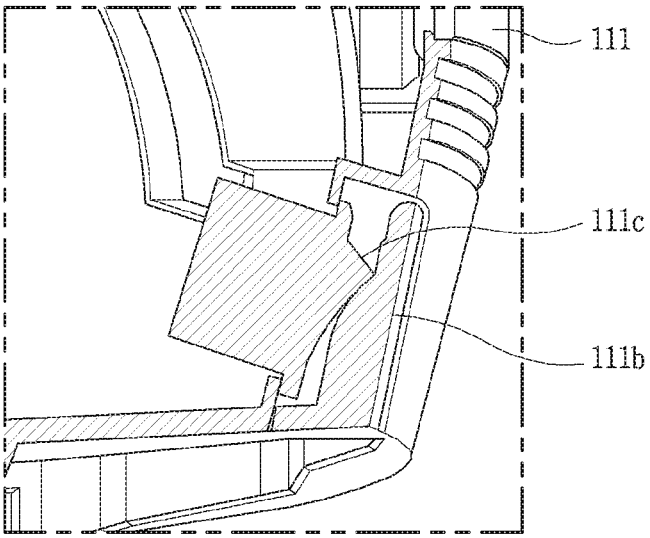
FIG. 15 is a sectional view showing an inner structure of a power switch and a switch cover.

FIGS. 13 and 14 are conceptual views partially showing appearance of the main housing 111 to which the switch cover 111*b* is exposed, and FIG. 15 is a sectional view showing an inner structure of a power switch 111*c* and the switch cover 111*b*. The power switch 111*c* is configured to turn on and turn off a power of the robot cleaner. Referring to FIG. 15, the power switch 111*c* is formed as a toggle switch. Referring to FIGS. 13 and 14, the switch cover 111*b* is installed outside the power switch 111*c*. The switch cover 111*b* is provided to be exposed to an outer surface of the main housing 111, and is formed to cover the power switch 111*c*.

Since the robot cleaner performs an autonomous cleaning operation while moving on a predetermined region according to a preset algorithm, it is not preferable to protrude a specific part of the switch cover 111*b* from the main housing 111. For instance, if the switch cover 111*b* protrudes from the main housing 111 excessively, the switch cover 111*b* may be locked to an object such as a wall or a door, while the robot cleaner is moving.

Further, it is preferable not to protrude the switch cover 111*b* from the main housing 111 for enhanced appearance of the robot cleaner. Especially, the switch cover 111*b* should not be protruding from the main housing 111 when the power switch 111*c* is turned on.

The switch cover 111*b* of the present disclosure forms a curved surface having a predetermined curvature together with an outer surface of the main housing 111, or forms a flat surface together with the outer surface of the main housing 111. Referring to FIGS. 13 and 15, when the power switch 111*c* is turned on (when part 'I' is pressed), the switch cover 111*b* forms a curved surface having a predetermined curvature together with the outer surface of the main housing 111.

On the other hand, referring to FIG. 14, when the power switch 111*c* is turned off (when part 'O' is pressed), the part 'I' of the switch cover 111*b* is protruding from the outer surface of the main housing 111. If the power switch 111*c* is formed as a push button switch and an elastic member is coupled to the switch cover 111*b*, the switch cover 111*b* may not be protruding from the main housing 111 regardless of an 'on' or 'off' state of the power switch 111*c*.

In the above descriptions, the robot cleaner to which the present disclosure is applied has been explained as an example. The robot cleaner is merely exemplary, and the present disclosure is not limited to such a robot cleaner. That is, the aforementioned structure may be also applicable to all types of cleaners including a canister type, an upright type, etc.

The present disclosure has the following aspects. Firstly, the cleaning module is inserted and mounted to the module mounting portion together with the supporting member, and is separated and withdrawn from the module mounting portion together with the supporting member. This is advantageous in a sanitary aspect. The reason is because most of dust is accumulated on the cleaning module rather than the supporting member, and a user can mount or separate the cleaning module to or from the module mounting portion without touching the cleaning module.

Further, since the supporting member and the cleaning module are inserted and withdrawn at a bottom part of the cleaner body in an upper and lower direction, convenience in mounting and/or separating the supporting member and the cleaning module may be enhanced. For instance, if a user lifts the cleaner body after pressurizing the manipulation portion of the hook coupling portion, the supporting member and the cleaning module may be separated from the module mounting portion by their weight. Accordingly, in the present disclosure, inconvenience in overturning the cleaner body may be solved.

Further, in the present disclosure, a type of the cleaning module is automatically recognized, and a cleaning algorithm is selected according to the recognized type of the cleaning module. This may enhance performance of the robot cleaner having an autonomous driving function and an automatic cleaning function.

Therefore, an aspect of the detailed description is to provide a cleaner capable of enhancing a user's sanitary aspect when managed and maintained. Especially, an aspect of the detailed description is to provide a cleaner capable of allowing a user to disassemble or separate components from a cleaner body without touching dust by hand.

Another aspect of the detailed description is to provide a cleaner capable of selectively replacing a predetermined type of cleaning member coupled to a cleaner body, and having an easy replacement structure. Another aspect of the detailed description is to provide a cleaner capable of automatically recognizing a type of a cleaning member coupled to a cleaner body. Another aspect of the detailed description is to provide a cleaner capable of coupling or separating a supporting member and a cleaning module to or from a cleaner body in a coupled manner.

To achieve these and other aspects, as embodied and broadly described herein, there is provided a cleaner, comprising: a cleaner body having a module mounting portion; a supporting member inserted and mounted to the module mounting portion, and separated and withdrawn from the module mounting portion, through a bottom part of the cleaner body; and a cleaning module coupled to the supporting member so as to be inserted or withdrawn together with the supporting member when the supporting member is inserted or withdrawn.

The cleaning module includes: a rotation rod rotatably supported by the supporting member, and coupled to the rotation driving portion by being inserted into the module mounting portion; and a cleaning member coupled to an outer circumferential surface of the rotation rod, and configured to clean a floor by being rotated together with the rotation rod when the rotation rod is rotated by a rotation driving force transmitted from the rotation driving portion.

The rotation rod includes: a rotation coupling member exposed to outside through one end of the rotation rod in an axial direction, and formed to be pressurized toward inside of the rotation rod; and an elastic member configured to provide an elastic force such that the rotation coupling member pressurized toward the inside of the rotation rod is restored to an initial position.

The module mounting portion includes an inclined surface formed at a contact position with the rotation coupling member while the cleaning module is being mounted such that the rotation coupling member is slid on a slant surface, the inclined surface being configured to gradually pressurize the rotation coupling member toward the inside of the rotation rod while the cleaning module is being mounted.

The inclined surface is formed to be closer to the rotation coupling member as it is towards inside of the module mounting portion. The rotation driving portion is formed to accommodate the rotation coupling member therein. And in a mounted state of the cleaning module to the module mounting portion, the rotation coupling member is pressurized by an elastic force provided from the elastic member to thus be inserted into the rotation driving portion.

The rotation driving portion is formed to accommodate the rotation coupling member therein. While the cleaning module is being mounted, the rotation coupling member sequentially passes through the inclined surface and an inner plane of the module mounting portion, and then is restored to an initial position by an elastic force provided from the elastic member to thus be inserted into the rotation driving portion.

The supporting member includes: a first supporting portion which encloses one end of the rotation rod so as to relative-rotatably support the rotation rod, and a second supporting portion which encloses another end of the rotation rod; and a first connection portion and a second connection portion spaced apart from each other, and configured to connect the first and second supporting portions with each other. And the cleaning member is exposed to a space between the first and second connection portions to clean a floor. The module mounting portion is provided with a protrusion protruding towards the supporting member, and the supporting member is provided with a hook coupling portion so as to be prevented from being separated from the module mounting portion.

The hook coupling portion includes: a first part protruding from one end of the supporting member towards inside of the module mounting portion; a second part bent from the first part, and protruding towards outside of the module mounting portion; a manipulation portion protruding from an end of the second part so as to manipulate the hook coupling portion; and a locking protrusion protruding from a middle region of the second part towards the protrusion, so as to be locked to the protrusion when the supporting member is inserted into the module mounting portion.

The locking protrusion includes: an inclined surface which contacts the protrusion while the supporting member is being inserted, and formed to be slidable along a surface of the protrusion; and a locking surface formed at an opposite side to the inclined surface, and formed to contact the protrusion in a mounted state of the supporting member to the module mounting portion.

In a mounted state of the supporting member to the module mounting portion, the manipulation portion is spaced apart from the cleaner body so as to be pressurized towards the cleaner body. When the manipulation portion is pressurized in an axial direction of the rotation rod, a coupled state between the protrusion and the locking protrusion is released.

The hook coupling portion is formed at an opposite side to the rotation coupling member. If a coupled state between the protrusion and the locking protrusion is released, the supporting member and the cleaning module are tilted on the basis of the rotation coupling member to thus be separated from the module mounting portion.

The cleaning module includes a first type cleaning module and a second type cleaning module which are selectively mountable to the supporting member, and a rotation rod of the first type cleaning module and a rotation rod of the second type cleaning module are provided with different number of contact terminals on the same position. The rotation driving portion is provided with a contact switch at a contact position with the contact terminal. And a controller of the cleaner recognizes a type of the cleaning module mounted to the module mounting portion according to the number of the contact terminal contacting the contact switch, and selects a cleaning algorithm of the cleaner based on the recognized type of the cleaning module.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cleaner, comprising:

a cleaner body having a bottom surface that includes a mounting recess;

a rotation driving gear provided at one side of the mounting recess;

a frame; and a cleaning head configured to be coupled to the frame so that the support frame and the cleaning head are inserted into or withdrawn together from the mounting recess, wherein the cleaning head includes:

a roller that is rotatably supported by the frame when the cleaning head is coupled to the frame, and that engages the rotation driving gear to receive a rotational driving force when the cleaning head is inserted into the mounting recess with the frame, and a cleaning extension provided on an outer circumferential surface of the roller, and configured to clean a floor when the roller is rotated by the rotation driving force transmitted from the rotation driving gear, wherein the cleaning head includes one of a first cleaning head having a first type of the cleaning extension or a second cleaning head having a second type of the cleaning extension which are selectively mountable to the frame, wherein the roller of the first cleaning head and the roller of the second cleaning head are provided with respective different numbers of contact terminals at a common position, wherein the rotation driving gear is provided with a contact switch at a contact position with the contact terminals when one of the first cleaning head or the second cleaning head is inserted in the mounting recess, and wherein the cleaner further comprises a controller configured to recognize whether the first cleaning head or the second cleaning head is inserted in the mounting recess based on the number of the contact terminals contacting the contact switch, and modifies operation of the cleaner based on whether the first cleaning head or the second cleaning head is mounted to the mounting recess.

2. The cleaner of claim 1, wherein the roller includes:

a rotation coupling button at a first axial end of the roller, the rotation coupling button being movable along an axis of the roller between an exposed position outside the first axial end of the roller and a depressed position at least partially inside the roller; and a spring configured to provide an elastic force such that the rotation coupling button is biased towards the exposed position, and wherein the mounting recess includes an inclined surface formed at a position contacting with the rotation coupling button while the cleaning head is being inserted such that the inclined surface provides a compression force to move the rotation coupling button towards the depressed position while the cleaning head is being inserted.

3. The cleaner of claim 2, wherein the inclined surface is slanted to be closer to the first axial end of roller inside of the mounting recess and away from the bottom surface of the cleaner body.

4. The cleaner of claim 2, wherein the rotation driving gear includes a recess configured to accommodate the rotation coupling button when the cleaning head is inserted in the mounting recess, and wherein, when the cleaning head is inserted in the mounting recess, the rotation coupling button is pressurized by the spring to be inserted into the recess of the rotation driving gear.

5. The cleaner of claim 2, wherein while the cleaning head is being inserted in the mounting recess, the rotation coupling button sequentially passes along the inclined surface to be compressed into the depressed positioned and then is restored to the exposed position by the elastic force provided from the spring to engage the rotation driving gear.

6. The cleaner of claim 2, wherein the frame includes:

a first wall which includes an opening that encloses one end of the roller so as to rotatably support the roller, and a second wall which encloses another end of the roller; and a first connection plate and a second connection plate that are spaced apart from each other and extend between the first and second portions walls, and wherein the cleaning head is exposed in a space between the first and second connection plates to clean a floor.

7. The cleaner of claim 6, wherein the mounting recess is provided with a protrusion extending towards the member, and wherein the frame is provided with a hook that engages a ledge on the protrusion of the mounting recess when the frame is received in the mounting recess.

8. The cleaner of claim 7, wherein the hook includes:

a first wall extending from one end of the frame and towards an interior of the mounting recess;

a second wall part contacting the first wall opposite the one end of the support frame, and extending out of the mounting recess;

a manipulation contact surface protruding from an end of the second wall so as to manipulate the hook; and a latch extending from the second wall and towards the ledge of the protrusion, so as to engage the ledge of the protrusion when the frame is inserted into the mounting recess.

9. The cleaner of claim 8, wherein the latch includes:

an inclined surface which contacts the ledge of the protrusion while the frame is being inserted in mounting recess, and configured be slide along a surface of the protrusion; and a locking surface formed at an opposite side to the inclined surface, and formed to contact the ledge of the protrusion when the frame is inserted to the mounting recess.

10. The cleaner of claim 8, wherein when the frame is inserted to the mounting recess, the latch contacts the ledge of the protrusion to apply a force moving the manipulation contact surface towards the cleaner body.

11. The cleaner of claim 10, wherein when a force is applied to the manipulation contact surface in an axial direction of the roller and away from the ledge of the protrusion, the latch is released from the ledge of the protrusion such that the frame can be removed from the mounting recess.

12. The cleaner of claim 10, wherein the hook is formed at an opposite side of the frame relative to the rotation coupling button, and wherein when the ledge of the protrusion and the latch are released from engagement, the frame and the cleaning head are tilted around the rotation coupling button accommodated in the rotation driving gear to be separated from the mounting recess.

13. The cleaner of claim 1, wherein first cleaning head includes a brush and the second cleaning head includes a mop, and wherein the controller is configured to deactivate a suction motor included in the cleaner when the second cleaning head is mounted in the mounting recess.

* * * * *